US005467984A

United States Patent [19]

Veux et al.

[11] Patent Number: 5,467,984

[45] Date of Patent: Nov. 21, 1995

[54] BALANCED GOLF CLUB

[75] Inventors: Jean-Luc Veux, Rumilly; Benoit Vincent, Annecy Le Vieux, both of France

[73] Assignee: Taylor Made Golf Company, Inc., Carlsbad, Calif.

[21] Appl. No.: 211,436

[22] PCT Filed: Oct. 17, 1991

[86] PCT No.: PCT/FR91/00813

§ 371 Date: Apr. 11, 1994

§ 102(e) Date: Apr. 11, 1994

[87] PCT Pub. No.: WO93/07935

PCT Pub. Date: Apr. 29, 1993

[51] Int. Cl.[6] ..... A63B 53/00; G01M 1/12

[52] U.S. Cl. ..... 273/81 R; 273/81 A; 273/80 R; 273/77 A; 273/169; 273/80.6; 73/65.03

[58] Field of Search ..... 273/167 R, 77 R, 273/77 A, 80 R, 81 R, 81 A, 186.2, 187.4, 80 A, 194 B, 80.6, 169, 167 F, 193 A, 194 R; 73/65.03

[56] References Cited

U.S. PATENT DOCUMENTS

| | | | |
|---|---|---|---|
| 4,058,312 | 11/1977 | Stuff | 273/77 A |
| 4,128,242 | 12/1978 | Elkins | 273/77 A |
| 4,240,631 | 12/1980 | MacDougall | 273/77 A |
| 4,415,156 | 11/1983 | Jorgensen | 273/77 A |
| 4,674,324 | 6/1987 | Benoit | 273/77 A X |
| 4,819,939 | 4/1989 | Kobayashi | 273/81 R |
| 4,887,815 | 12/1989 | Hughes | 273/77 A |
| 4,900,025 | 2/1990 | Suganuma | 273/77 A |
| 4,971,321 | 11/1990 | Davis | 273/77 A |
| 5,152,527 | 10/1992 | Mather | 273/77 A |

FOREIGN PATENT DOCUMENTS

| | | |
|---|---|---|
| 2628643 | 9/1989 | France . |
| 2670121 | 6/1992 | France . |
| 2670120 | 6/1992 | France . |
| 2182252 | 5/1987 | United Kingdom . |

*Primary Examiner*—Sebastiano Passaniti
*Attorney, Agent, or Firm*—Sandler, Greenblum & Bernstein

[57] ABSTRACT

The invention is directed to a golf club, such as a driver, wherein the club includes a shaft, at the lower end of which a head is mounted, and at the upper end of which a grip is mounted. The club is light in weight and has a mass of less than 340 grams and an LPE/LC ratio (Equivalent Pendulum Length)/(Length of Club) of less than 0.87, preferably between 0.87 and 0.85.

37 Claims, 7 Drawing Sheets

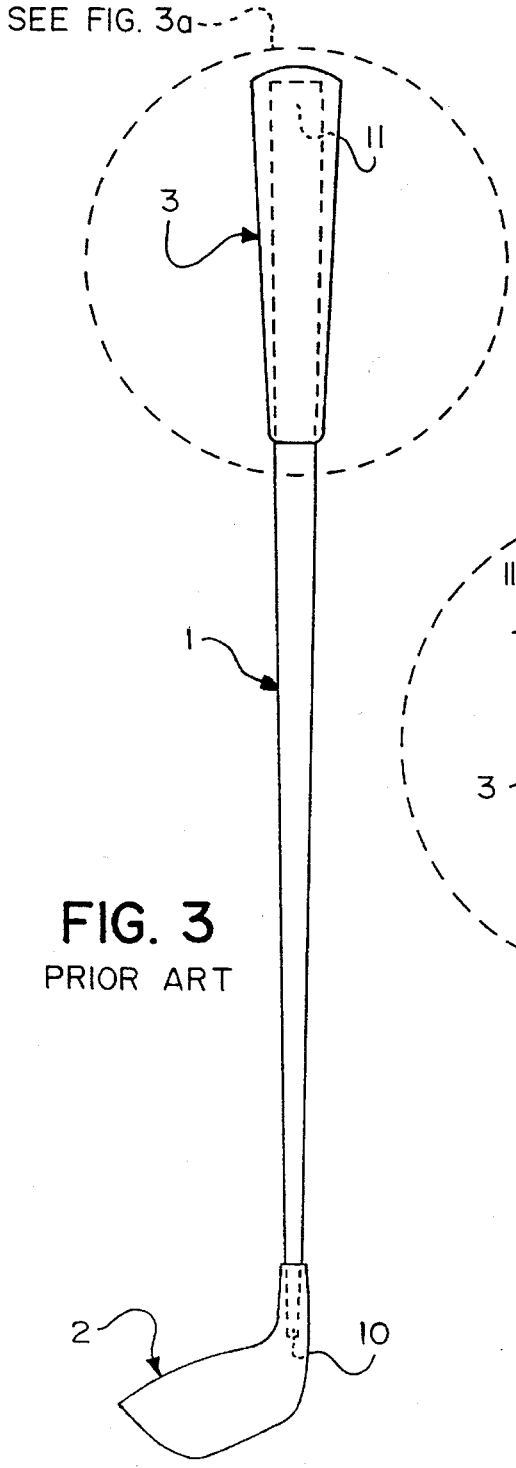
FIG. 3
PRIOR ART
FIG. 3a
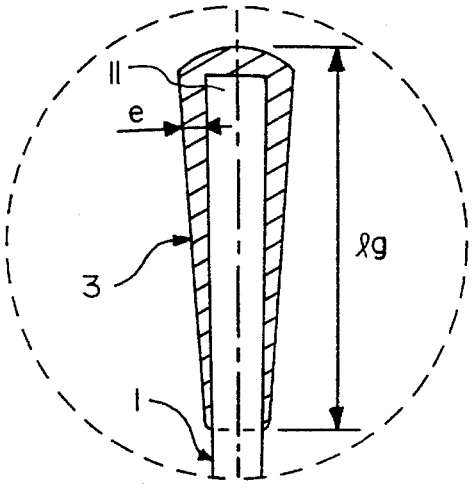
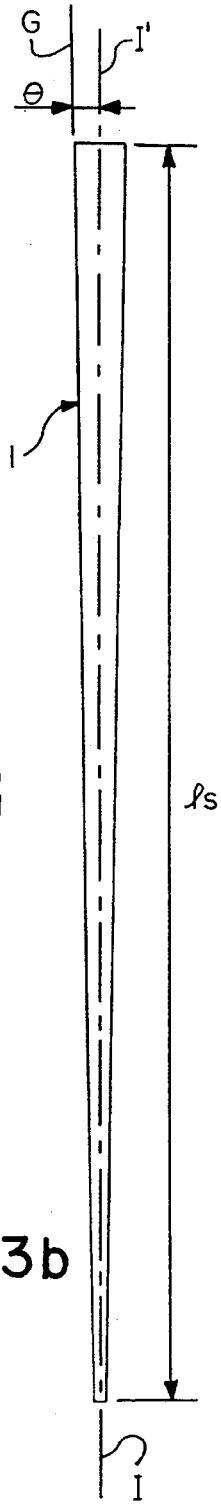
FIG. 3b

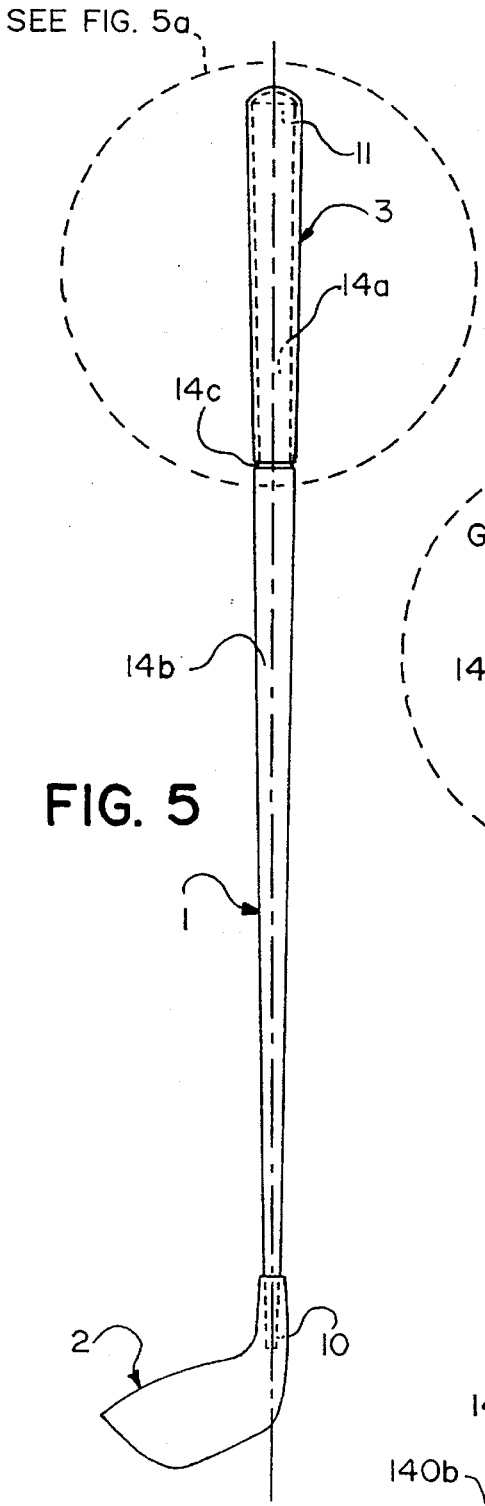
FIG. 5
FIG. 5a
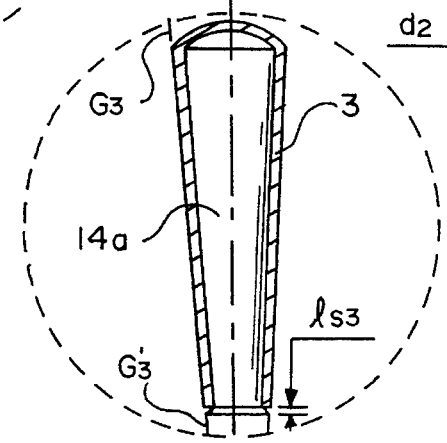
FIG. 5b
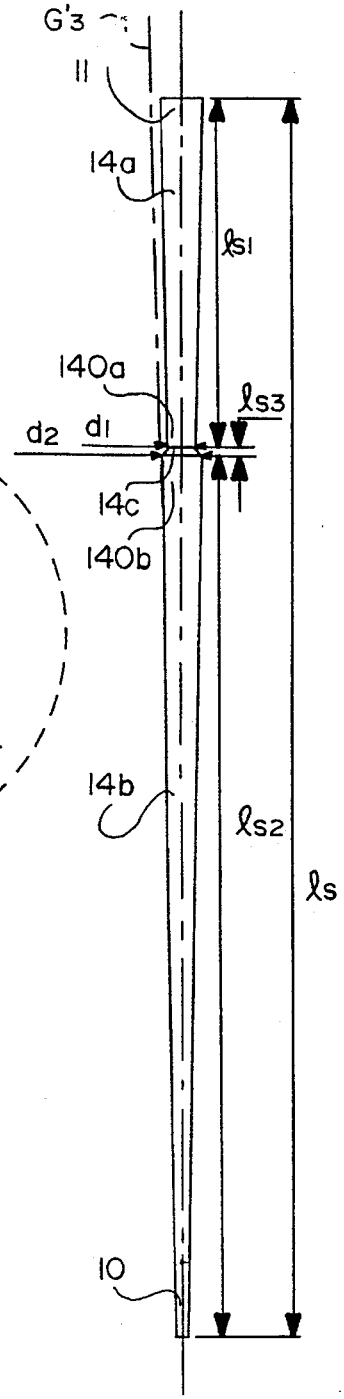
FIG. 5c
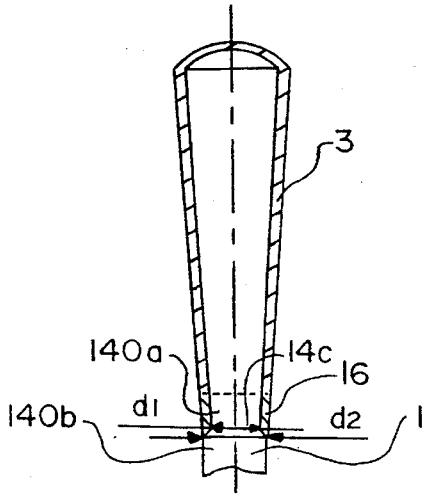

BALANCED GOLF CLUB

BACKGROUND OF THE INVENTION

1. Field of the Invention

The present invention relates to an improved golf club, more specifically, of the "wood" type, as well as to a set of golf clubs comprising such a club and having the same advantages thereof.

2. Description of Background and Relevant Information

A golf club basically includes a handle commonly known as a "shaft", at the lower end of which the head or impact member is affixed, and at the upper end of which is the "grip".

The current tendency is to produce light-weight golf clubs for the purpose, on the one hand, to improve the performance of the club in terms of the length and accuracy of the golf shot, and on the other hand, to improve the player's comfort in the game, whether the player is a beginner or a professional.

The reduction in the weight of the club head directly influences the distance of the shot and causes the opposite effect from the effect that is sought. Also, the gain in mass is obtained along the shaft by virtue of composite material technology. Clubs equipped with such shafts make it possible to increase the distance of a shot by approximately 10% compared to distance obtained with clubs equipped with conventional shafts.

In spite of these advantages, most golfers do not like this type of light-weight club because of the unpleasant sensations felt during the impact movement, commonly referred to as the "swing", due to poor dynamic balancing of the club In particular, poor dynamic balancing is known by the applicants to directly influence the trajectory of the ball, resulting in a "slice" i.e., a trajectory curving towards the right for a right-handed player (curving towards the left for a left-handed player), or a "hook", i.e., a trajectory curving towards the left for a right-handed player (curving towards the right for a left-handed player).

It is for these various reasons that players on professional golf circuits continue to use certain conventional clubs, referred to as "heavy" clubs, whose shafts are generally metal or graphite, which they find correctly balanced but whose performance is inferior to that of clubs whose lightened shafts are made of carbon fiber, for example.

SUMMARY OF THE INVENTION

An object of the present invention is to overcome the aforementioned disadvantages, particularly by proposing a lightened club, therefore an efficient club, whose dynamic balancing is identical to, or very close to, that of clubs preferred by most golfers.

An object of the invention also is to propose a correlated set of golf clubs having the same advantages as the club thus produced.

To these ends, the club of the invention is constituted by a shaft, at the upper end of which a grip is affixed, and at the lower end, a head is affixed, the total mass of the club being less than 340 grams and wherein the ratio of the length of the equivalent pendulum along the length of the club is less than 0.87, preferably between 0.85 and 0.87.

A complementary characteristic of the invention is that the distribution of mass along the club is such that the mass of the grip and shaft represent 30 to 40% of the total mass of the club.

Another characteristic of the invention is that the grip is light and its mass is less than or equal to 35 grams.

BRIEF DESCRIPTION OF THE DRAWINGS

Other characteristics and advantages of the invention will become apparent from the following description with reference to the non-limiting, annexed drawings and wherein

FIG. 3 illustrates a simplified view of a golf club of the prior art;

FIG. 3*a* illustrates an enlarged detail of FIG. 3, especially the upper portion of the club;

FIG. 3*b* illustrates the shaft of the club of FIG. 3;

FIG. 5 illustrates a variation of the club of FIG. 4;

FIG. 5*a* illustrates a detail of FIG. 5;

FIG. 5*b* illustrates the shaft of the club of FIG. 5;

FIG. 5*c* illustrates an improvement of the club of FIG. 5;

DETAILED DESCRIPTION OF PREFERRED EMBODIMENTS

Figure 1:
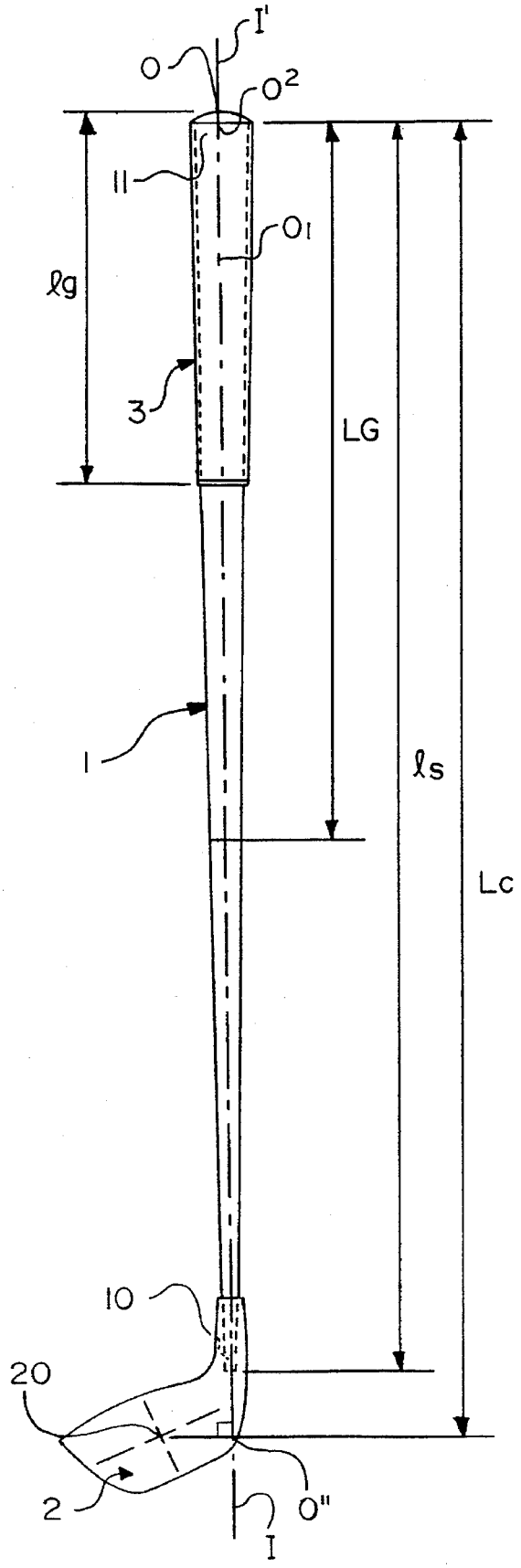
FIG. 1 illustrates a simplified view of the club according to the invention.

The golf club of FIG. 1 has a shaft 1 having a length is and a mass ms at the lower end 10 of which a head 2 with a mass mt is affixed. At the upper end 11 of the shaft 1 is affixed a grip 3 having a mass mg and a length lg and extending along a portion of the length of the shaft. Conventionally, the length LC of the club is considered as being the length measured between a point 0' along the longitudinal axis I–I' of the shaft located at 5 millimeters (mm) from the upper end or point 0 of the grip 3, and a point 0" corresponding to the perpendicular projection along the axis I–I' of the center of gravity 20 of the head 2 of the club.

The club of the invention mainly concerns a "driver" i.e., the club having the greatest length LC among the clubs of a given set of clubs. But, as will be explained below, the invention extends in the same manner to any clubs of a given set which have the same previously defined advantages as the driver.

According to manufacturers, the driver is a club whose length LC can vary from 1041.4 mm (41 inches) for the shortest to approximately 1143.0 mm (45 inches). As a general rule, the average length is approximately 1092.2 mm (43 inches).

Figure 2:
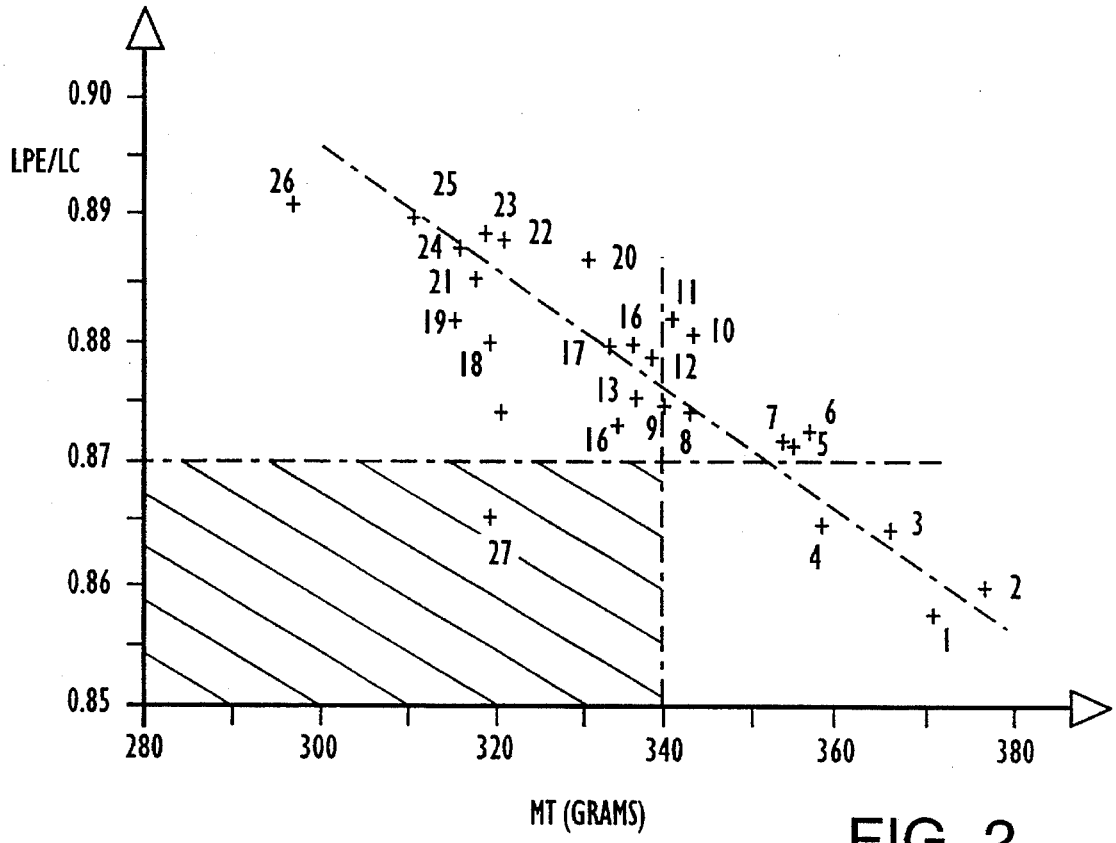
FIG. 2 is a diagram showing the positioning of a club according to the invention, comparing its characteristics to those of conventional known clubs.

For these club lengths, the diagram of FIG. 2 shows the measurements undertaken on twenty-six drivers on the market, to be compared with a driver of the invention. In this diagram, the X axis represents the total mass MT of the driver expressed in grams, and the Y axis the ratio of the equivalent pendulum length LPE and the length LC (i.e., the ratio LPE/LC) of the club.

The LPE is given in millimeters (mm) and corresponds to a length equivalent to that of a simple pendulum whose oscillation period T is equal to that of the club if the club were to be pivotally mounted about a point 01 corresponding to the rotation point of the club in the hands of the golfer. In the example, the LPE is located along the axis I–I' at 101.6 mm (4 inches) from point 0.

The measurement of the LPE can be obtained by different means, such as those disclosed in U.S. Pat. No. 4,674,324. As an example, one can cite the simplest method which consists of pivoting the club about the point 01 and measuring its oscillation period T. The LPE is then obtained by the following formula:

$LPE=(T^2g)/4\pi^2$, whereby g is the gravitational constant expressed in $mm/s^2$.

The characteristic of the invention is illustrated in FIG. 2. Among the twenty-six represented market clubs, the applicants found that among the so-called heavy-weight drivers numbered from 1 to 11, having a mass greater than approximately 340 grams, only the clubs 1 to 4, having a LPE/LC ratio less than 0.87, have satisfactory dynamic balancing during the "swing". The clubs numbered 5 to 11 were generally found to be unsatisfactory, as well as the so-called light-weight clubs, i.e., those whose mass is less than 340 grams and numbered from 12 to 26.

On the other hand, the clubs 12 to 26 were shown to perform better in terms of starting speed of the ball and, therefore, in terms of the distance obtained with the ball after having been striken with the club. This fact has enabled the applicants to determine the characteristics of the driver of the invention, whose total mass MT is less than 340 grams, preferably between 280 and 340 grams, and whose LPE/LC ratio is less than 0.87, preferably between 0.87 and 0.85.

An advantageous complementary characteristic of the invention consists of distributing the mass along the club in such a way that the sum of the mass mg of the grip and the mass ms of the shaft is between 30% and 40% of the total mass MT of the club, which enables maintaining a conventional head mass of greater than 190 grams, at least.

The point 27 in FIG. 2 illustrates the position in the diagram of an example of a club according to the invention having a total mass equal to 322 grams, and an LPE/LC ratio equal to 0.866. As an example, the characteristics of such a club are shown in the following table (for a static moment d2 of the logarithmic scale of the "swing weight" measured at 14 inches or 355.6 mm of 0):

TABLE 1

| | Club | Head | Shaft | Grip |
|---|---|---|---|---|
| Mass (in grams) | 322 | 205 | 82 | 35 |
| Position of the Cdg (in mm) | 840 (with respect to 0) | 1095 (with respect to 0') | 499 (with respect to 0') | 100 (with respect to 0) |
| Inertia (in kg · m²) | $4.983 \cdot 10^{-2}$ | $2.2 \cdot 10^{-4}$ | $7.1 \cdot 10^{-1}$ | $2.3 \cdot 10^{-4}$ |
| Length (in mm) | 1095 (LC) | | 1057.3 | 260 |

Generally, the distribution of the mass, the inertia, the center of gravity of the club and the various elements constituting the club can be determined by the following formulas:

$$LPE\ (at\ 101.6\ \text{mm. or 4 in.})=Ic/(MT(Gc-0.1016))+(Gc-0.1016)$$

whereby:

MT is the total mass of the club, equal to mg+ms+mt, expressed in kg;

$G_c$ is the position of the center of gravity of the club from the point 0, expressed in m;

Ic is the moment of inertia of the club, expressed in kg.m² and calculated by the Huygens theorem according to the formula:

$$Ic=Is+Ig+It+(mg(G-Gg)^2)+(ms(G-Gs-0.005)^2)+mt(LC-G)^2)$$

whereby in this formula:

G, Gs, Gg are expressed in m; and mg, ms, mt are expressed in kg;

and whereby:

Gg is the position of the center of gravity of the grip with respect to 0;

Gs is the position of the center of gravity of the shaft with respect to 0;

Is is the moment of inertia of the shaft with respect to Gs;

Ig is the moment of inertia of the grip with respect to Gg; and

It is the moment of inertia of the head with respect to the center of gravity 20 of the head.

The following various constructions are provided as examples and are in no way limiting.

In a preferred embodiment of the invention, the lightening of the club can be obtained by choosing a grip whose mass mg is less than 35 grams, preferably between 25 and 35 grams. For that, one can provide that the grip, generally made of an elastomer material, has a low and substantially constant thickness of approximately 1 to 2.5 mm. In this particular case, and according to the previously described formulas, the characteristics of mass ms, position of the center of gravity Gs and inertia Is of the shaft can be optimized by calculation.

Thus, one can define a mass ms of the shaft to be between and 100 grams, preferably between 80 and 90 grams.

The results shown in the following table are provided as specific examples for a fixed grip mass of 35 grams, and under the same conditions as in the example of Table 1:

TABLE 2

| ms (in g) | Gs (mm) | Is (kg · m²) | mt (in g) |
|---|---|---|---|
| 82 | 500.2 | $7.08 \cdot 10^{-3}$ | 205.5 |
| 83 | 507.4 | $7.43 \cdot 10^{-3}$ | 204.5 |
| 84 | 514.4 | $7.77 \cdot 10^{-3}$ | 203.5 |
| 85 | 521.2 | $8.10 \cdot 10^{-3}$ | 202.5 |

Advantageous characteristics of the invention and especially of the previously described preferred embodiment, are illustrated in FIGS. 4, 4*a*, 4*b*, 5, 5*a*, 5*b* in comparison with the prior art illustrated in FIGS. 3, 3*a*, 3*b*.

FIG. 3 shows a golf club of the prior art equipped with a shaft 1, a head 2 and a grip 3. The shaft 1 has a uniform shape of a truncated cone whose smallest section is located at its lower end 10 which is embedded in the head 2, and whose largest section is located at its upper end 11 from which the grip 3 extends. By uniform truncated cone shape it is understood that the generatrix G of the truncated cone formed by the shaft 1 is substantially rectilinear and forms an angle Θ with the median longitudinal axis I–I' as shown in FIG. 3*b*. For ergonomic playing reasons, the thickness e of the grip is variable along the shaft and increases towards the end 11 of the shaft so that the section is adequate in the prehension zone of the hands.

Figure 4:
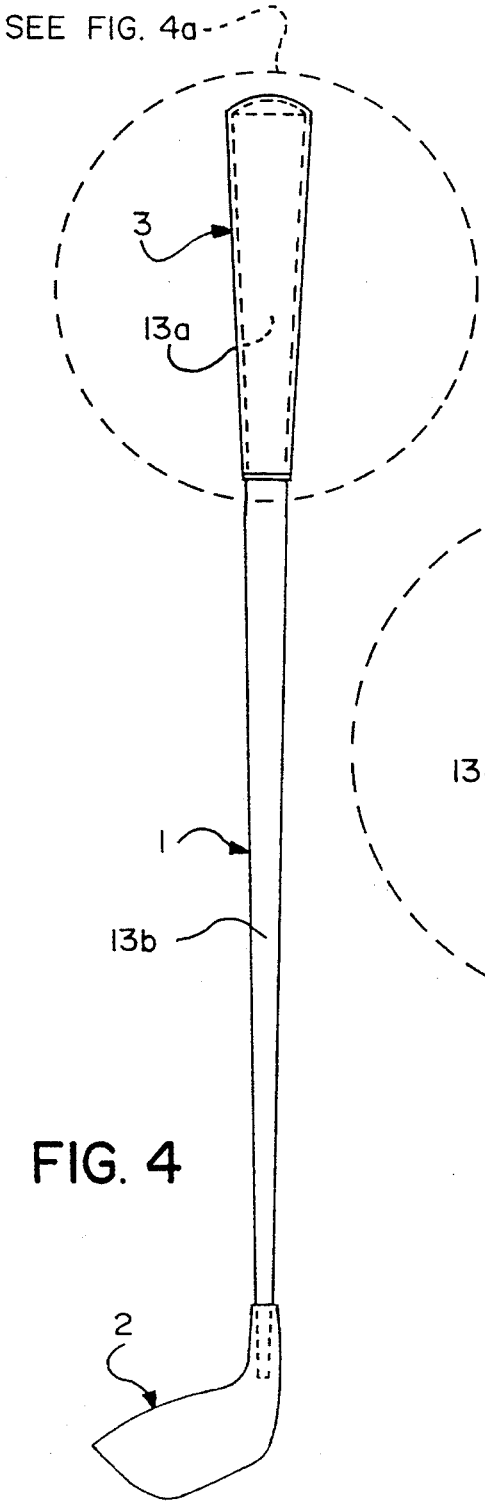
FIG. 4 illustrates a simplified view of a golf club according to the invention.
Figure 4A:
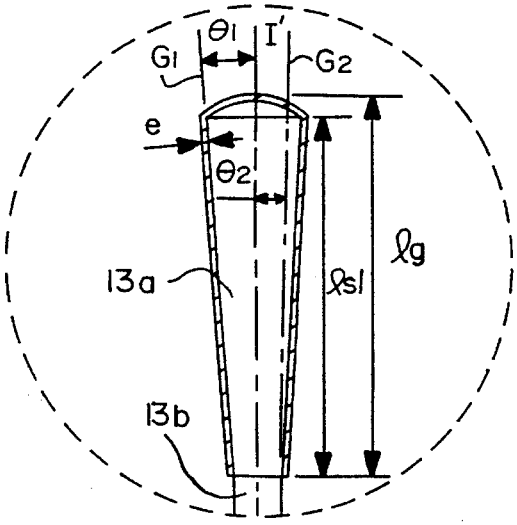
FIG. 4*a* illustrates an enlarged detail of FIG. 4.
Figure 4B:
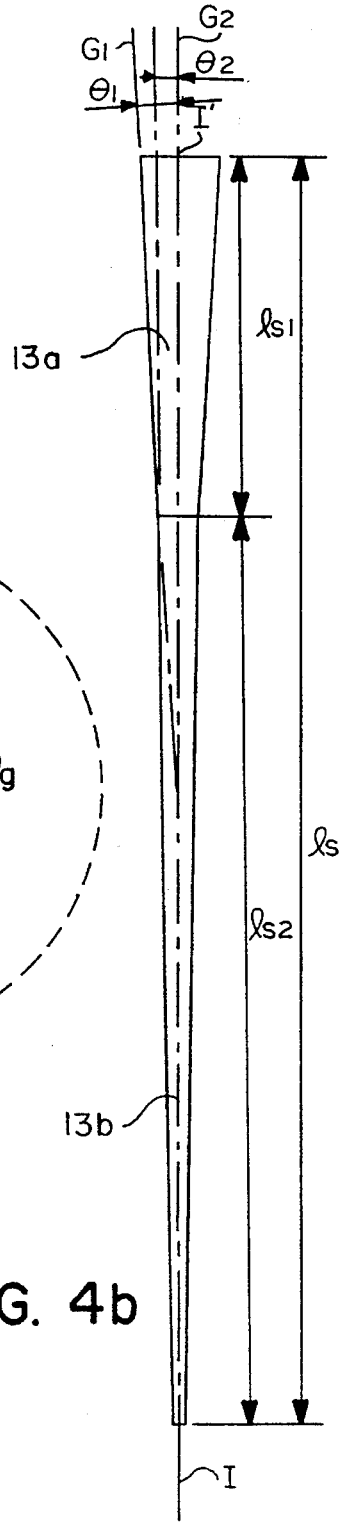
FIG. 4*b* illustrates the shaft of the club of FIG. 4.

In a complementary characteristic of the invention illustrated in FIG. 4, 4*a* and 4*b*, the shaft 1 comprises a first portion 13*a* in the shape of a truncated cone with a length ls1, partially or totally covered by the grip 3 having a substantially constant low thickness with a length lg. The shaft comprises a second remaining portion 13*b* in the shape of a truncated cone with a length ls2 also connecting to the first portion 13*a*. The generatrix G1 of the first portion 13*a* has an average angle Θ1 with respect to the axis I–I' and greater than the average angle Θ2 formed between the generatrix G2 of the second portion 13b and the axis I–I'. In the example described, the generatrices G1 and G2 are rectilinear but they can have a slight curvature, especially for the generatrix G1 of the portion 13*a*.

The special advantage of the embodiment of FIGS. 4 to 4*b*, and which adds to the previously described advantages of the invention, is mainly that the shaft maintains its ergonomic qualities in the tightening region of the hands because of its special configuration.

FIGS. 5 to 5*c* show another possible example of the shaft 1 configuration leading to the same advantages. The shaft 1 comprises an upper first truncated portion 14*a* with a length ls1, covered totally or only partially by the grip 3 with a length lg. A second truncated portion 14*b* not covered by the grip, extends to the lower end 10 of the shaft. The lower end 140*a* with a diameter d1 of the first portion 14*a* is connected to the upper end 140*b* of the second portion 14*b* with a diameter d2 by means of a third connecting portion 14*c* with a length ls3. The diameter d1 of the first portion is less than the diameter d2 of the second portion. The generatrix G3 of the grip 3 can be advantageously merged with the generatrix G'3 of the second portion 14*b*. In this manner, the grip is integrated flush with the shaft 1. In addition, in this case, the diameter d2 of the second portion being uniformly greater than the diameter of a shaft of the prior art such as that of FIG. 3, the shaft is more rigid in flexion and in torsion than a conventional shaft, without being heavier.

FIG. 5*c* shows an improvement provided to the club of FIG. 5 on which a connection ring 16 is added, covering the third connecting portion 14*c*. This ring can be advantageously produced as a viscoelastic material having shock-absorbing properties, for example.

The shafts 1 of the examples of FIGS. 4*b* and 5*b* are preferably produced from a carbon fiber and organic resin-based composite structure of the epoxy type, for example. The manufacturing process of such shafts is disclosed in the commonly owned French Patent application Nos. 90 15387 and 90 15388, published as Nos. 2,670,120 and 2,670,121, respectively.

Of course, these shafts can be produced by other more conventional methods well known by one of ordinary skill in the art.

Figure 6:
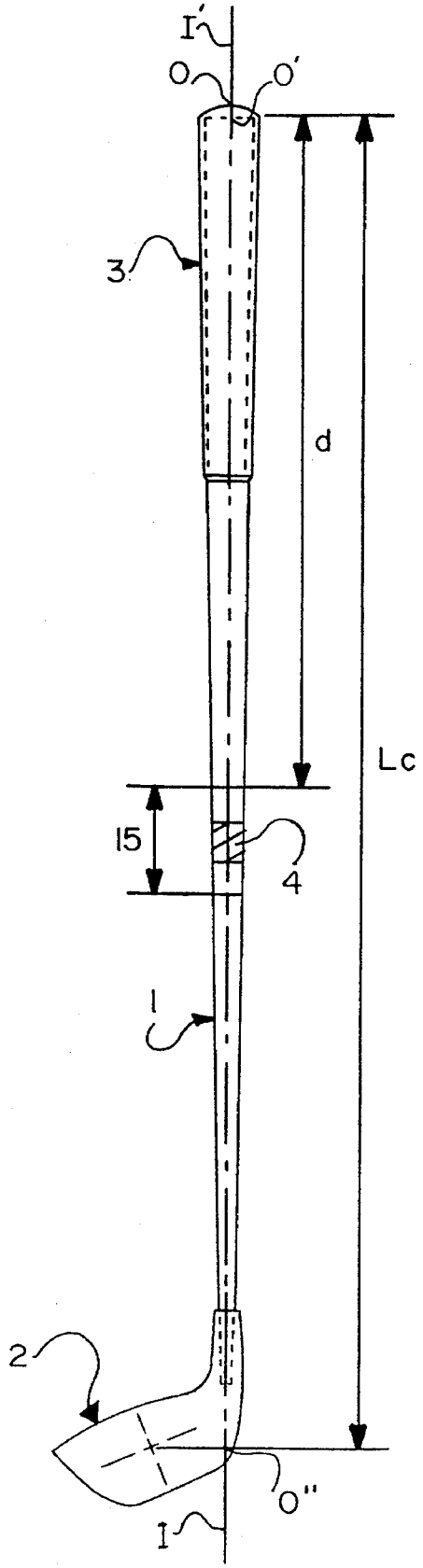
FIGS. 6 and 6*a*–6*d* illustrate a golf club of the invention according to another embodiment.

FIG. 6 illustrates another embodiment of the invention. In this case, the grip 3 is conventional and has a mass (mg) between 45 and 55 grams, preferably 50 grams. The shaft 1 is very light and has a mass of less than 80 grams and a weight 4 localized in a zone 15 located at a distance d from 0' equal to approximately 0.5 LC and a length equal to approximately 0.15 LC.

Figure 7:
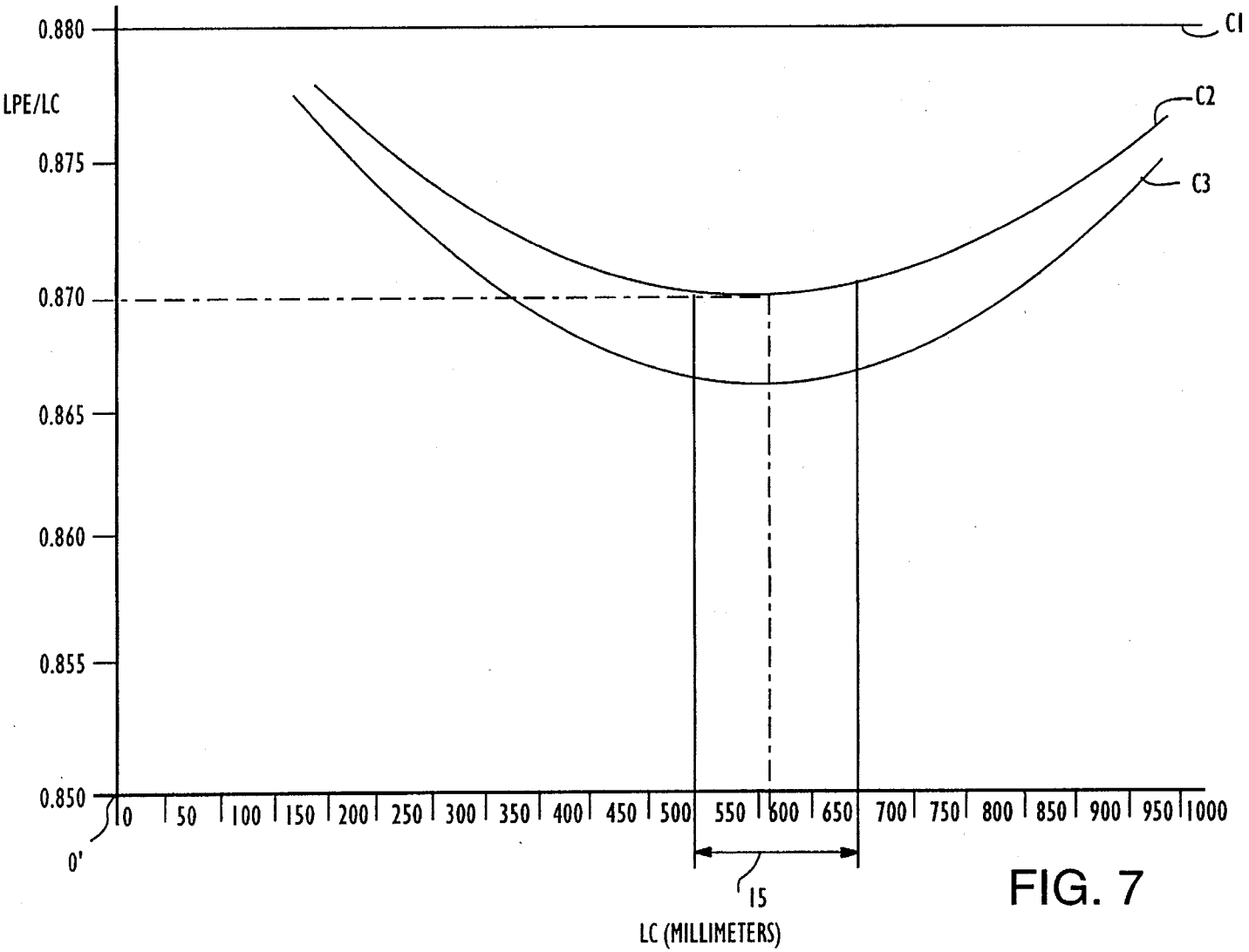
FIG. 7 is a diagram showing the variation of the LPE/LC ratio as a function of the position of a weight on the shaft of the club of FIG. 6.

The weight has a mass between 1 and 40 grams. The zone 15 defined within the scope of the invention corresponds to the zone for which the dynamic balancing is obtained by adding the minimum of mass by the weight. This characteristic is illustrated as a guide in the diagram of FIG. 7 which shows the variation of the LPE/LC ratio as a function of the position of the weight 4 with respect to point 0'.

The X axis represents the length of the club LC (expressed in mm) and the Y axis represents the LPE/LC ratio.

The curve C1 illustrates an example of a non-weighted shaft whose balancing is unsatisfactory.

The curves C2 and C3 illustrate two examples with a weight of 12 and 16 grams, respectively.

The other parameters of curves C1, C2 and C3 are provided in the following table as examples (for a static moment d2 or "swing weight" of the club at 14 inches):

TABLE 3

| | C1 | C2 | C3 |
|---|---|---|---|
| Club | | | |
| LC (mm) | 1095 | 1095 | 1095 |
| MT (g) | 329.5 | 337 | 339.9 |
| Gc (m) | 829.9 | 819 | 815 |
| Ic (kg · m²) | 0.05637 | 0.05645 | 0.05662 |
| Shaft | | | |
| 1s | 1057 | 1057 | 1057 |
| Ms | 65 | 65 | 65 |
| Gs | 495 | 495 | 495 |
| Is | 0.0065 | 0.0065 | 0.0065 |
| Grip | | | |
| 1p | 260 | 260 | 260 |
| mp | 50 | 50 | 50 |
| Gp | 100 | 100 | 100 |
| Ip | 0.00029 | 0.00029 | 0.00029 |

The shaft 1 of FIG. 6 is made from carbon fibers and a resin-based composite material.

Figure 6A:
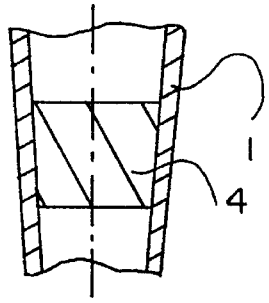
Figure 6B:
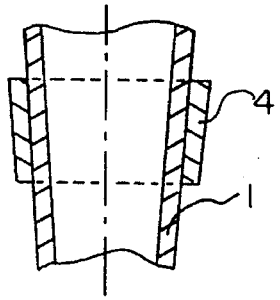
Figure 6C:
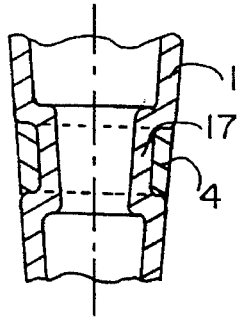
Figure 6D:
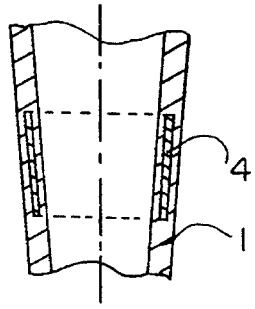

The weight 4 can be arranged inside the shaft 1, as shown in FIG. 6*a*. In this case, the weight can be constituted by a plug made of an elastomer or other deformable material. One can also envision arranging a ring-shaped weight 4 on the external surface of the shaft 1 as in the case of FIG. 6*b*. The weight can also be positioned within a housing 17 provided for this purpose so as to be flush with the external surface of the shaft, as is illustrated in FIG. 6*c*. Finally, the weight 4 can be incorporated into the internal structure of the shaft as shown in FIG. 6*d*.

The use of a weight in the defined zone 15 can also be envisioned in the first embodiment of the invention, illustrated in FIGS. 4 to 5*b*, if a readjustment of the dynamic balancing proves to be necessary after the manufacturing process of the club because of the dispersion of its various component elements. In this case, the addition of mass is very small and in the order of only 1 to 10g.

The present invention also extends to a set of golf clubs comprising at least one club of the invention and of which each club of the set has a LPE/LC ratio less than 0.87 and preferably between 0.87 and 0.85.

In the normal declination of a set, the other clubs of the set have a total mass greater than that of the club of the invention, if the latter is the driver, because of the mass of the head which increases as LC decreases in the set. Therefore, the mass of the head can vary from a minimum mass of 190 grams for a driver, to a maximum mass of 350 grams for a putter.

A complementary characteristic of the set golf clubs of the invention is that each club can be balanced according to the conventional technique of static balancing known as "swing weighting", without substantially modifying the LPE/LC ratio for each club. The technique of "swing weighting" consists of balancing each club of the set by modification of the mass of the head so as to have the same static moment measured at 355.6 mm (14 inches or 355.6 mm of 0). As an example, the formula of the static moment as a function of the mass of the club is:

$$SW=MT\ (Gc-0.3556)$$

whereby:

SW is expressed in kg.m;

MT is expressed in kg, with MT=mg+ms+mt; and

Gc is expressed in m.

Of course, the invention is not limited to the embodiments described and represented as examples, but also includes all the technical equivalents as well as the combinations thereof.

We claim:

1. A golf club comprising:

a shaft having a lower end and an upper end;

a head mounted at the lower end of the shaft;

a grip mounted at the upper end of the shaft;

a total mass of less than 340 grams;

an equivalent pendulum length (LPE);

a club length (LC); and a ratio of equivalent pendulum length to club length (LPE/LC) less than 0.87.

2. A golf club according to claim 1, wherein:

the ratio of equivalent pendulum length to club length (LPE/LC) is between 0.87 and 0.85.

3. A golf club according to claim 1, wherein:

the golf club comprises a predeterminate total mass;

the grip comprises a predeterminate grip mass;

the shaft comprises a predeterminate shaft mass; and the sum of the grip mass and the shaft mass is equal to between 30% and 40% of said predeterminate total mass of the golf club.

4. A golf club according to claim 3, wherein:

the grip has a mass of less than 35 grams.

5. A golf club according to claim 4, wherein:

the grip has a mass of between 25 and 35 grams.

6. A golf club according to claim 4, wherein:

the shaft has a mass of between 70 and 100 grams.

7. A golf club according to claim 6, wherein:

the shaft has a mass of between 80 and 90 grams.

8. A golf club according to claim 3, wherein:

the grip has a mass of between 45 and 55 grams.

9. A golf club according to claim 8, wherein:

the shaft has a mass of less than 80 grams.

10. A golf club according to claim 3, wherein:

the grip has a predeterminate length and a predeterminate thickness, the thickness being substantially constant along the predeterminate length of the grip.

11. A golf club according to claim 10, wherein:

the predeterminate thickness of the grip being between 1.0 millimeters and 2.5 millimeters.

12. A golf club according to claim 1, wherein:

the grip has a mass of less than 35 grams.

13. A golf club according to claim 24, wherein:

the grip has a mass of between 25 and 35 grams.

14. A golf club according to claim 12, wherein:

the shaft has a mass of between 70 and 100 grams.

15. A golf club according to claim 14, wherein:

the shaft has a mass of between 80 and 90 grams.

16. A golf club according to claim 1, wherein:

the grip has a mass of between 45 and 55 grams.

17. A golf club according to claim 16, wherein:

the shaft has a mass of less than 80 grams.

18. A golf club according to claim 17, further comprising:

a weight located at a zone of the shaft a predetermined distance approximately equal to 0.5 of the club length (LC) from an end of the shaft, the weight having a length approximately equal to 0.15 of the club length (LC).

19. A golf club according to claim 18, wherein:

the weight has a mass between 1 and 40 grams.

20. A golf club according to claim 18, wherein:

the weight comprises a plug positioned within the shaft.

21. A golf club according to claim 20, wherein:

the plug comprises a deformable material.

22. A golf club according to claim 21, wherein:

the deformable material comprises an elastomer.

23. A golf club according to claim 18, wherein:

the weight comprises a ring positioned on an external surface of the shaft.

24. A golf club according to claim 23, wherein:

the shaft comprises a housing recessed within an external surface of the shaft and surrounding a portion of the length of the shaft; and the weight comprises a ring positioned within the housing and being flush with the external surface of the housing.

25. A golf club according to claim 18, wherein:

the shaft is tubular with a predeterminate thickness; and the weight is incorporated within the predeterminate thickness of the shaft.

26. A golf club according to claim 1, wherein:

the grip has a predeterminate length and a predeterminate thickness, the thickness being substantially constant along the predeterminate length of the grip.

27. A golf club according to claim 26, wherein:

the predeterminate thickness of the grip being between 1.0 millimeters and 2.5 millimeters.

28. A golf club according to claim 27, wherein:

the shaft comprises:

a longitudinal axis;

a first portion comprising a first truncated cone with a first predeterminate length, the first truncated cone having a generatrix with a first average angle with respect to the longitudinal axis of the shaft, whereby the grip at least partially covers the first portion of the shaft;

a second portion connected to and extending from the first portion, the second portion of the shaft comprising a second truncated cone with a second predeterminate length, the second truncated cone having a generatrix with a second average angle with respect to the longitudinal axis of the shaft;

the first average angle being greater than the second average angle.

29. A golf club according to claim 27, wherein:

the shaft comprises:

a lower end;

an upper first portion comprising a first truncated cone with a first predeterminate length, whereby the grip at least partially covers the first portion of the shaft, the upper first portion having a lower end, the lower end of the upper first portion having a predeterminate diameter;

a lower second portion comprising a second truncated cone with a second predeterminate length, the second truncated cone extending to the lower end of the shaft, the grip not covering the lower second portion of the shaft, the lower second portion of the shaft having an upper end, the upper end of the lower second portion of the shaft having a predeterminate diameter, the predeterminate diameter of the lower end of the upper first portion of the shaft being less than the predeterminate diameter of the upper end of the lower second portion of the shaft; and a third portion having a third predeterminate length, the third portion of the shaft connected to the upper first portion of the shaft and the lower second portion of the shaft.

30. A golf club according to claim 26, wherein:

the shaft comprises:

a longitudinal axis;

a first portion comprising a first truncated cone with a first predeterminate length, the first truncated cone having a generatrix with a first average angle with respect to the longitudinal axis of the shaft, whereby the grip at least partially covers the first portion of the shaft;

a second portion connected to and extending from the first portion, the second portion of the shaft comprising a second truncated cone with a second predeterminate length, the second truncated cone having a generatrix with a second average angle with respect to the longitudinal axis of the shaft;

the first average angle being greater than the second average angle.

31. A golf club according to claim 26, wherein:

the shaft comprises:

a lower end;

an upper first portion comprising a first truncated cone with a first predeterminate length, whereby the grip at least partially covers the first portion of the shaft, the upper first portion having a lower end, the lower end of the upper first portion having a predeterminate diameter;

a lower second portion comprising a second truncated cone with a second predeterminate length, the second truncated cone extending to the lower end of the shaft, the grip not covering the lower second portion of the shaft, the lower second portion of the shaft having an upper end, the upper end of the lower second portion of the shaft having a predeterminate diameter, the predeterminate diameter of the lower end of the upper first portion of the shaft being less than the predeterminate diameter of the upper end of the lower second portion of the shaft; and a third portion having a third predeterminate length, the third portion of the shaft connected to the upper first portion of the shaft and the lower second portion of the shaft.

32. A correlated set of golf clubs comprising:

at least two golf clubs with different lengths, each golf club of said correlated set comprising:

a shaft having a lower end and an upper end;

a head mounted at the lower end of the shaft;

a grip mounted at the upper end of the shaft;

an equivalent pendulum length to club length (LPE);

a club length (LC);

a ratio of equivalent pendulum length to club length (LPE/LC) less than 0.87; and at least one golf club of said correlated set having a total mass of less than 340 grams.

33. A correlated set of golf clubs according to claim 32, wherein for each golf club of said correlated set:

the ratio of equivalent pendulum length to club length (LPE/LC) is between 0.87 and 0.85.

34. A correlated set of golf clubs according to claim 32, wherein for each golf club of said correlated set:

the golf club comprises a predeterminate total mass;

the grip comprises a predeterminate grip mass;

the shaft comprises a predeterminate shaft mass; and the sum of the grip mass and the shaft mass is equal to between 30% and 40% of said predeterminate total mass of the golf club.

35. A correlated set of golf clubs according to claim 32, wherein:

each golf club has the same static moment measured at 355.6 millimeters from an end of the shaft.

36. A correlated set of golf clubs according to claim 32, wherein:

the head of each golf club has a mass within the range of 190 grams to 350 grams.

37. A correlated set of golf clubs according to claim 35, wherein:

the head of each golf club has a mass within the range of 190 grams to 350 grams.

* * * * *